US007063540B2

(12) United States Patent
Sun et al.

(10) Patent No.: US 7,063,540 B2
(45) Date of Patent: Jun. 20, 2006

(54) CONNECTOR

(75) Inventors: Chin-Kai Sun, Banciao (TW); Wen-Hsiung Shih, Changhua (TW)

(73) Assignee: BenQ Corporation, Taoyuan Shien (TW)

( * ) Notice: Subject to any disclaimer, the term of this patent is extended or adjusted under 35 U.S.C. 154(b) by 0 days.

(21) Appl. No.: 11/086,859

(22) Filed: Mar. 22, 2005

(65) Prior Publication Data

US 2005/0221632 A1 Oct. 6, 2005

(30) Foreign Application Priority Data

Mar. 31, 2004 (TW) ..... 93108928 A

(51) Int. Cl.
*H01R 12/00* (2006.01)

(52) U.S. Cl. ..... 439/65; 439/500; 439/862

(58) Field of Classification Search ..... 439/65, 439/66, 74, 862, 500, 71
See application file for complete search history.

(56) References Cited

U.S. PATENT DOCUMENTS 5,885,090 A * 3/1999 Comstock et al. ..... 439/65
5,888,846 A * 3/1999 Miyata et al. ..... 438/105
6,077,130 A * 6/2000 Hughes et al. ..... 439/862
6,302,727 B1 * 10/2001 Fedorjaka ..... 439/500
6,863,540 B1 * 3/2005 Spykerman ..... 439/66
6,875,049 B1 * 4/2005 Kyowski et al. ..... 439/500

* cited by examiner

*Primary Examiner*—Alexander Gilman
(74) *Attorney, Agent, or Firm*—Thomas, Kayden, Horstemeyer & Risley

(57) ABSTRACT

A connector for electrically connecting a first circuit board and a second circuit board includes an L-shaped main body, a first contacting spring, a second contacting spring and a positioning spring. The L-shaped main body has a lateral side, a bottom side and a supporting portion. The first contacting spring is disposed on the lateral side and is electrically connected to the first circuit board disposed on the supporting portion. The second contacting spring is disposed on the bottom side and is electrically connected to the first contacting spring and the second circuit board. The positioning spring is disposed on the lateral side and on the top of the first contacting spring. The first circuit board is confined and positioned along a first direction as a result of the presence of the positioning spring.

18 Claims, 7 Drawing Sheets

CONNECTOR

This application claims the benefit of Taiwan application Serial No. 93108928, filed Mar. 31, 2004, the subject matter of which is incorporated herein by reference.

BACKGROUND OF THE INVENTION

1. Field of the Invention

The invention relates in general to a connector, and more particularly to a connector for electrically connecting two circuit boards.

2. Description of the Related Art

Currently, the communication module disposed in a mobile phone or a notebook computer normally electrically connects two circuit boards via a ball grid array (BGA) interface or a leadless chip carrier (LCC) interface.

Referring to FIG. 1, a conventional diagram of electrically connecting two circuit boards via a BGA interface is shown. Communication module 100, which is disposed in a mobile phone or a notebook computer, includes a main circuit board 102, and a functional circuit board 104 capable. of executing plural communication functions of plural functional elements 106.

The functional circuit board 104 is electrically connected to the main circuit board 102 via plural solder balls 108 using surface mounted technology (SMT) manufacturing process.

Referring to FIG. 2, a conventional diagram of electrically connecting two circuit boards via a LCC interface is shown. Communication module 200 includes a main circuit board 202, and a functional circuit board 204 capable of executing plural communication functions of plural functional elements 206.

The lateral side of the functional circuit board 204 has plural adjacent through holes (not shown in the diagram) disposed thereon. The functional circuit board 204 is electrically connected with the main circuit board 202 via the through holes using the solder paste 208. In practical implementation, first of all, solder paste 208 is disposed on the electrical contact points of the main circuit board 202; the electrical contact points are disposed correspondingly to the through holes on the functional circuit board 204. Next, the functional circuit board 204 is disposed on the main circuit board 202; the through holes are aligned to the electrical contact points with the solder paste 208. Then, the main circuit board 202 and the functional circuit board 204 are sent into the heating furnace for melting the solder paste 208 to joint the through holes effectively with the electrical contact points, so that the functional circuit board 204 and the main circuit board 202 can be electrically connected.

In the above disclosure, no matter the functional circuit board and the main circuit board are electrically connected via a BGA interface or an LCC interface, if the communication module is dropped or suffered an external force (the user drops off the mobile phone or the notebook computer to the ground for instance), the solder balls or the solder paste connected between the functional circuit board and the main circuit board might not be able to resist the shear stress caused by the external force. Consequently, the mobile phone or the notebook computer might not function normally.

SUMMARY OF THE INVENTION

It is therefore an object of the invention to provide a connector and a connector module, providing stronger combination for the two circuit boards as an interface of electrical connection. Furthermore, the electrical connection is not easy to be broken down when suffering an external force impact.

The invention achieves the above-identified object by providing a connector used for electrically connecting a first circuit board and a second circuit board. The connector includes an L-shaped body, a first contact elastic piece, a second contact elastic piece and a positioning elastic piece. The L-shaped body has a lateral side, a bottom and a supporting portion. The supporting portion is for supporting the first circuit board. The first contact elastic piece is disposed on the connector lateral side for being electrically connected with the first circuit board supported by the supporting portion. The second contact elastic piece is disposed on the connector bottom and is electrically connected with the first contact elastic piece. The second contact elastic piece is used for being electrically connected with the second circuit board. The positioning elastic piece is disposed above the first contact elastic piece on the lateral side for abutting the first circuit board supported by the supporting portion, so that the first circuit board can be positioned at a first direction.

The connector of the invention disclosed above can further include a positioning pillar disposed on the supporting portion, while the first circuit board can have an indented groove corresponding to the positioning pillar. The positioning pillar is for being accommodated in the indented groove of the first circuit board supported by the supporting portion, so that the first circuit board can be positioned toward a second direction. Besides, the connector of the invention disclosed above can also include a positioning pillar disposed on the supporting portion, while the first circuit board has a through hole corresponding to the positioning pillar. The positioning pillar is for pinning through the through hole of the first circuit board supported by the supporting portion, so that the first circuit board can be positioned toward a second direction and a third direction.

Moreover, the connector of the invention disclosed above can further include a conductive element, wherein part of the conductive element is disposed inside the L-shaped body and another part of the conductive element forms the first contact elastic piece and the second contact elastic piece. Besides, the conductive element of the connector of the invention disclosed above can further include a positioning elastic piece. Apart from forming the first contact elastic piece and the second contact elastic piece, the conductive element forms a positioning elastic piece as well. The first contact elastic piece, the second contact elastic piece and the positioning elastic piece are integrally formed.

In the connector of the invention disclosed above, the first contact elastic piece, the second contact elastic piece and the positioning elastic piece can respectively be an elastic piece.

According to the above object, the invention further provides another connector module used for electrically connecting a first circuit board and a second circuit board, wherein the first circuit board has a through hole. The connector module includes an L-shaped body, a first contact elastic piece, a second contact elastic piece, a positioning pillar, a base unit and a cover. The L-shaped body has a lateral side, a bottom and a supporting portion, wherein the supporting portion is for supporting the first circuit board. The first contact elastic piece is disposed on the lateral side and used for being electrically connected with the first circuit board supported by the supporting portion. The second contact elastic piece, disposed on the bottom, is electrically connected with the first contact elastic piece and used for being electrically connected with the second circuit board. The positioning pillar is disposed on the supporting portion and corresponds to the through hole for pinning through the through hole on the first circuit board supported by the supporting portion, so that the first circuit board can be fastened on the supporting portion. The base unit is for supporting the second circuit board, the L-shaped body and the first circuit board, which are integrated together. The cover, having a positioning hole corresponding to the positioning pillar, is coupled with the base unit. The positioning hole retains the positioning pillar so that the second contact elastic piece is electrically connected with the second circuit board firmly.

The connector of the invention disclosed above can further include a positioning elastic piece, wherein the positioning elastic piece is disposed above the first contact elastic piece on the lateral side for abutting the first circuit board supported by the supporting portion, so that the first circuit board can be positioned toward a first direction.

Moreover, the connector module according to the invention can further include a conductive element, wherein part of the conductive element is disposed inside the L-shaped body and another part of the conductive element forms a first contact elastic piece and a second contact elastic piece. Besides, the conductive element of the connector module according to the invention can further include a positioning elastic piece.

In the connector module according to the invention, the first contact elastic piece, the second contact elastic piece and the positioning elastic piece can respectively be an elastic piece.

Other objects, features, and advantages of the invention will become apparent from the following detailed description of the preferred but non-limiting embodiments. The following description is made with reference to the accompanying drawings.

DETAILED DESCRIPTION OF THE INVENTION

The invention is exemplified by a preferred embodiment. However, the preferred embodiment is not to limit the scope of protection of the invention. The preferred embodiment herein is a connector and a connector module under the spirit of the invention. The technical characteristics of the invention are disclosed below.

Figure 1:
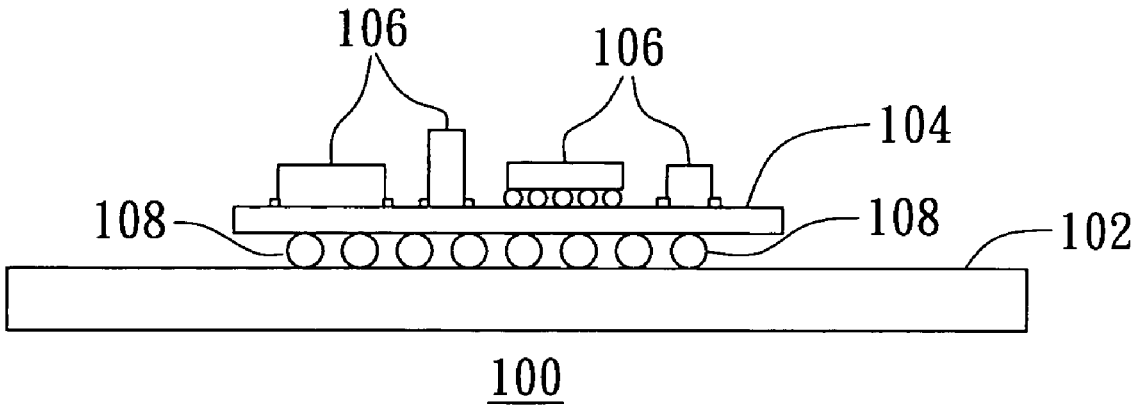
FIG. 1(PRIOR ART)
FIG. 1 (Prior Art) is a conventional diagram of electrically connecting two circuit boards via a BGA interface.
Figure 2:
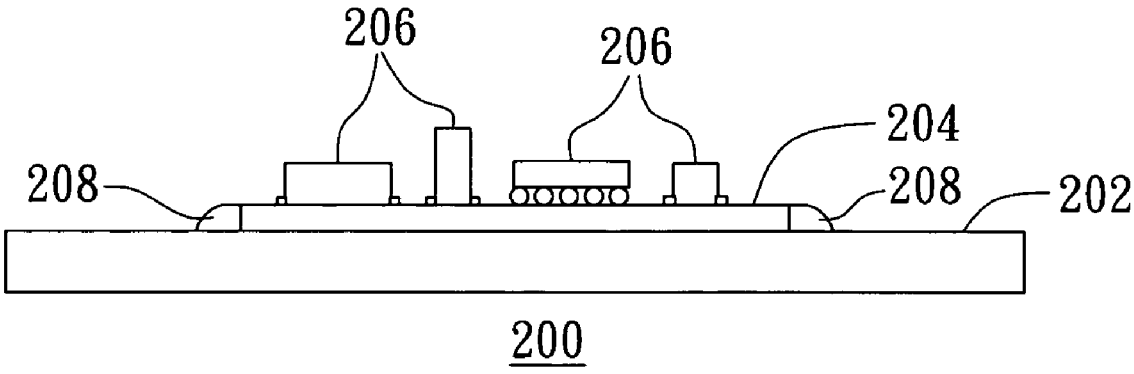
FIG. 2(PRIOR ART)
FIG. 2 (Prior Art) is a conventional diagram of electrically connecting two circuit boards via a LCC interface.
Figure 3A:
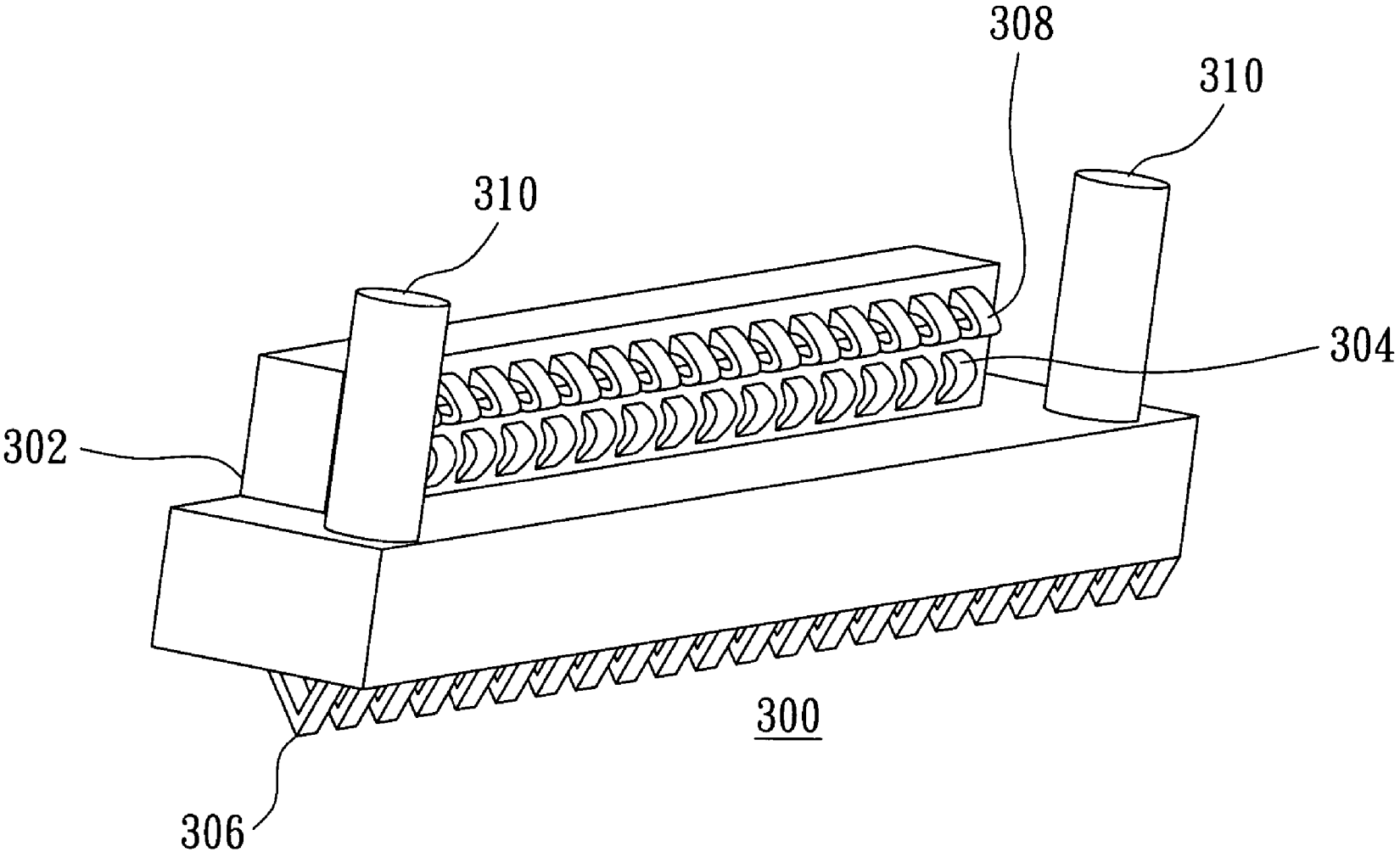
FIG. 3A is a diagram of a connector according to a preferred embodiment of the invention.
Figure 3B:
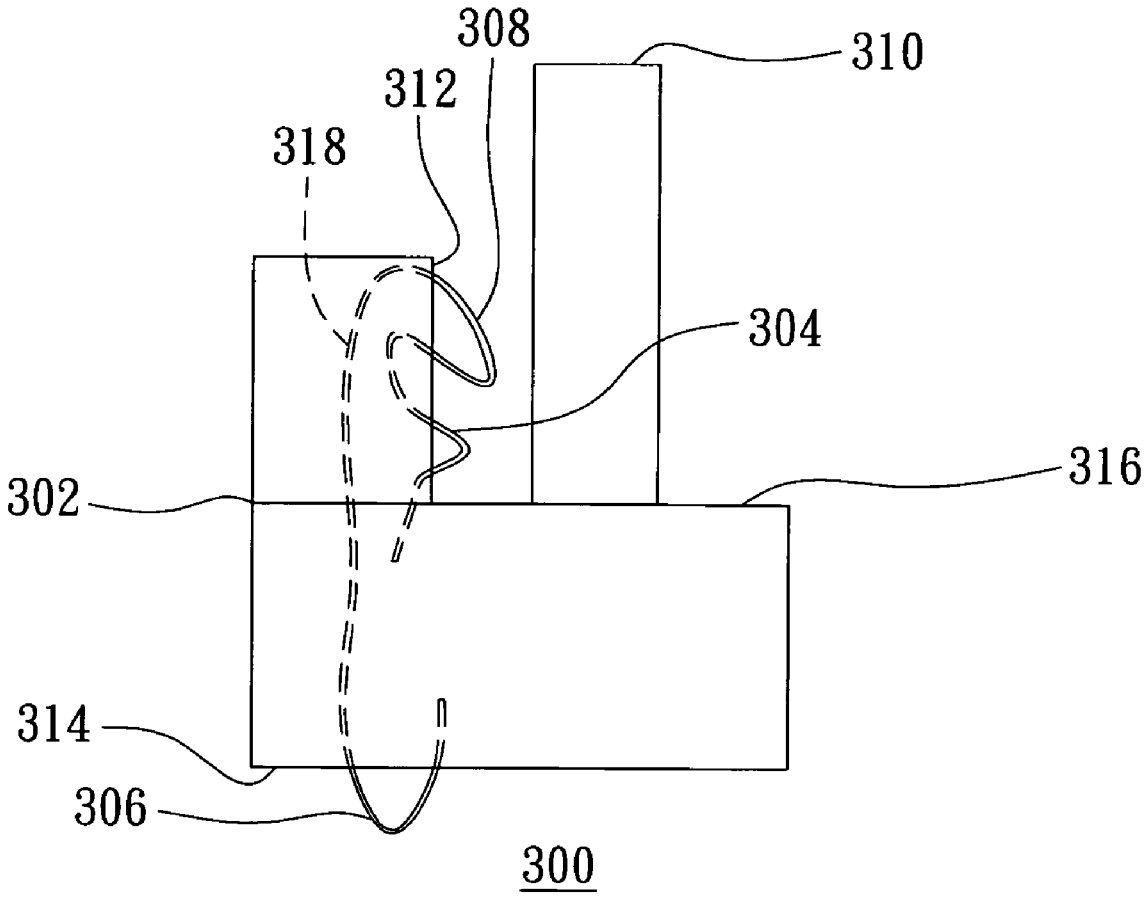
FIG. 3B is a side view of the connector in FIG. 3A.

Referring to both FIG. 3A and FIG. 3B, FIG. 3A is a diagram of a connector according to a preferred embodiment of the invention, while FIG. 3B is a side view of the connector according to FIG. 3A. Connector 300 includes an L-shaped body 302, a plurality of first contact elastic pieces 304, a plurality of second contact elastic pieces 306, a plurality of positioning elastic pieces 308, and positioning pillars 310.

Figure 4:
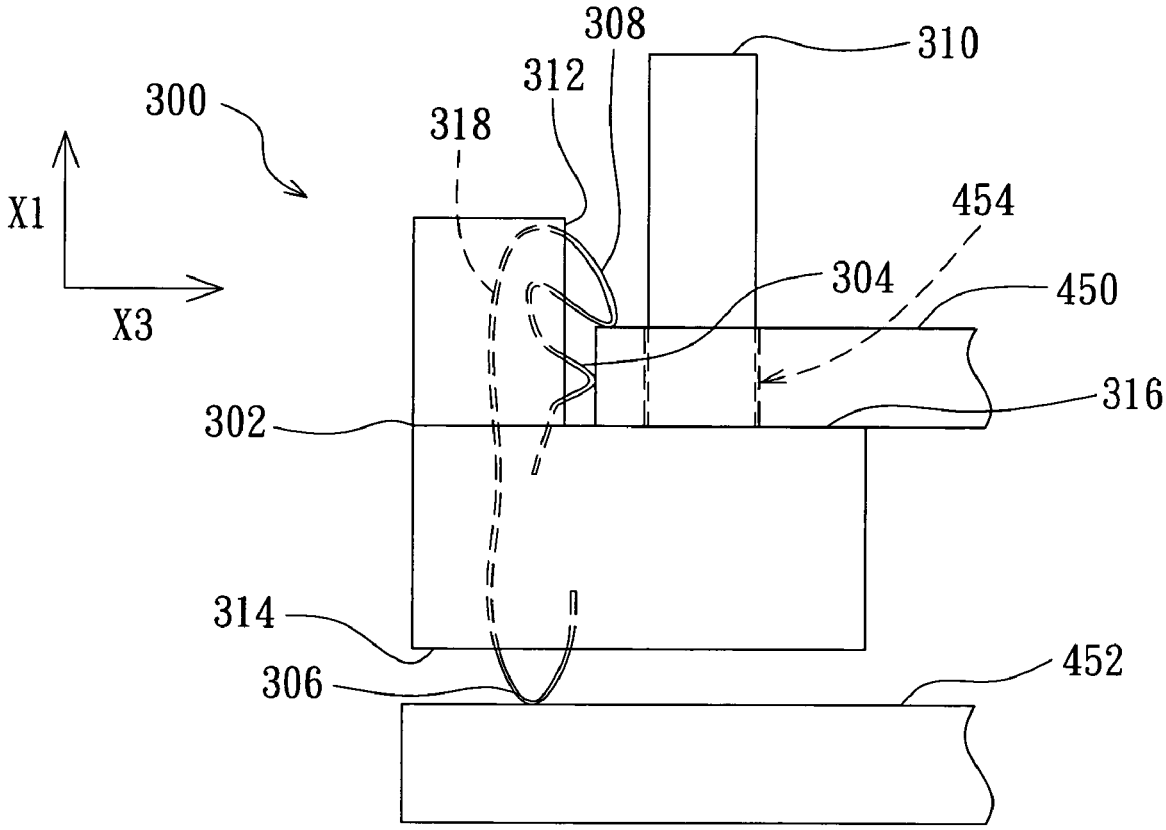
FIG. 4 is a diagram of the connector electrically connecting the first circuit board and the second circuit board according to the preferred embodiment of the invention.

Referring to FIG. 4, a diagram of the connector electrically connecting the first circuit board and the second circuit board according to the preferred embodiment of the invention is shown. The first circuit board 450 can be a functional circuit board, while the second circuit board 452 can be a main circuit board. The L-shaped body 302 of the connector 300 has a lateral side 312, a bottom 314 and a supporting portion 316. The supporting portion 316 is for supporting the first circuit board 450 as shown in FIG. 4. The first contact elastic piece 304 is disposed on a lateral side 312 of the L-shaped body 302, wherein corresponding to the first contact elastic pieces 304, a plurality of electrical contact points on the first circuit board 450 (not shown in the diagram) are disposed thereon. The first contact elastic pieces 304 are electrically connected with the first circuit board 450 via the electrical contact points disposed on the first circuit board 450.

As shown in FIG. 3B and FIG. 4, the positioning elastic piece 308 is disposed above the first contact elastic piece 304 on the lateral side 312. The positioning elastic piece 308 is for abutting the first circuit board 450, so that the first circuit board 450 can be positioned toward a first direction X1 as shown in the diagram. That is to say, since the first circuit board 450 can be restricted by the positioning elastic piece 308 to be at the first direction X1 and cannot move along the first direction X1, the first circuit board 450 can be fastened on supporting portion 316.

The second contact elastic piece 306 is disposed on the bottom 314 of the L-shaped body 302 and is electrically connected with the first contact elastic piece 304. Furthermore, the second contact elastic piece 306 is used for being electrically connected with the second circuit board 452. The corresponding part of the second contact elastic piece 306 on the second circuit board 452 has plural electrical contact points corresponding to the second contact elastic piece 306 (not shown in the diagram). The second contact elastic piece 306 is used for electrically connected with the second circuit board 452 via the electrical contact points disposed on the second circuit board 452. Via the electrical connection between the first contact elastic piece 304 and the second contact elastic piece 306, the first circuit board 450 and the second circuit board 452 can be electrically connected together.

Figure 5:
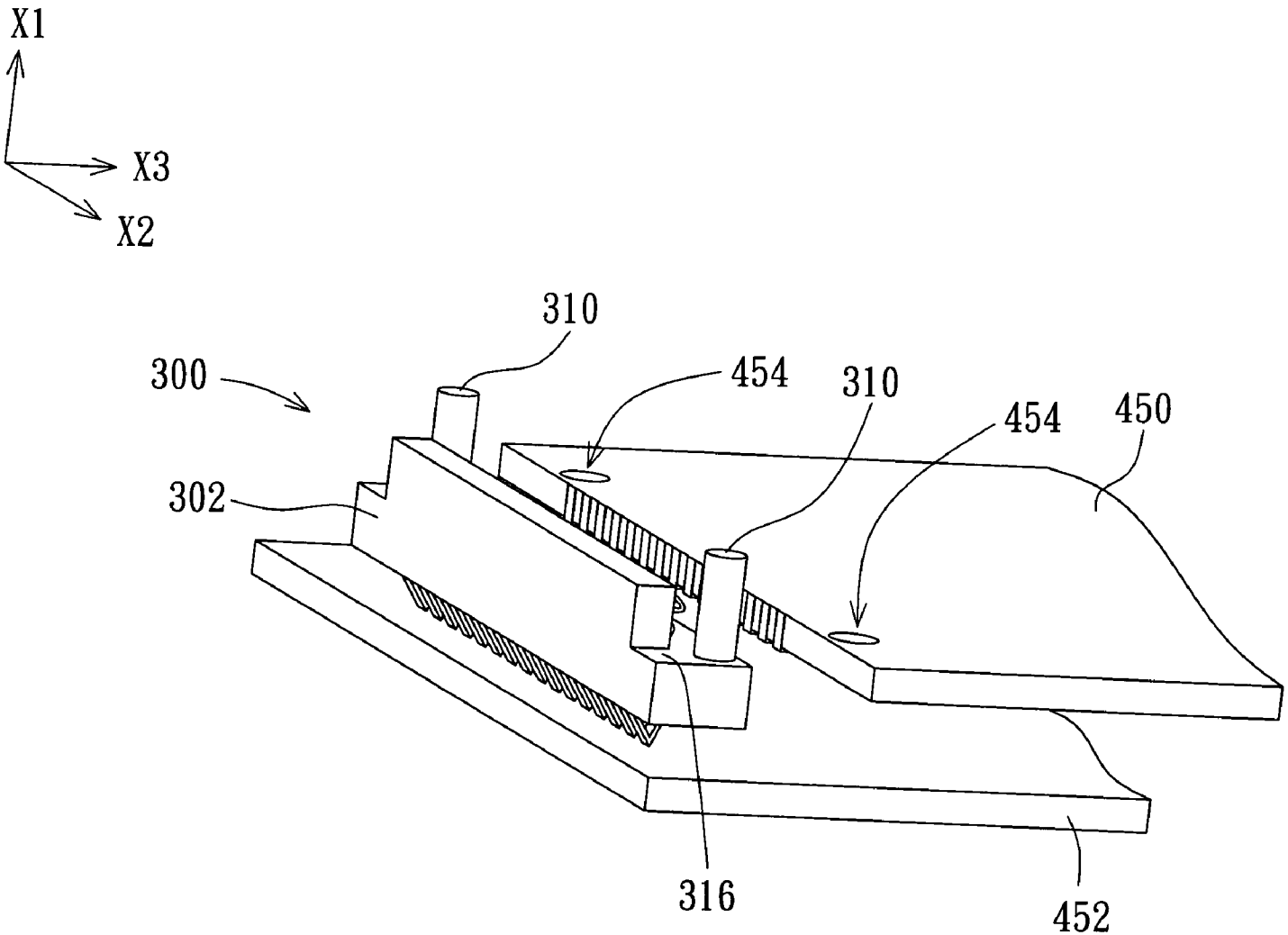
FIG. 5 is an exploded view of the first circuit board, connector, and second circuit board.

Referring to both FIG. 4 and FIG. 5, FIG. 5 is an exploded view of the first circuit board, connector and second circuit board. The positioning pillar 310 is disposed on the supporting portion 316 of the L-shaped body 302. The first circuit board 450 has a through hole 454 corresponding to the positioning pillar 310.

The positioning pillars 310 are for pinning through the through hole 454 of the first circuit board 450 supported by the supporting portion 316, so that the first circuit board 450 can be positioned toward a second direction X2 and a third direction X3 as shown in the diagram for the first circuit board 450 to be fastened on the supporting portion 316. That is, the first circuit board 450 will be restricted to the second direction X2 and the third direction X3 by the positioning pillars 310 and cannot move along the second direction X2 and the third direction X3.

Figure 6:
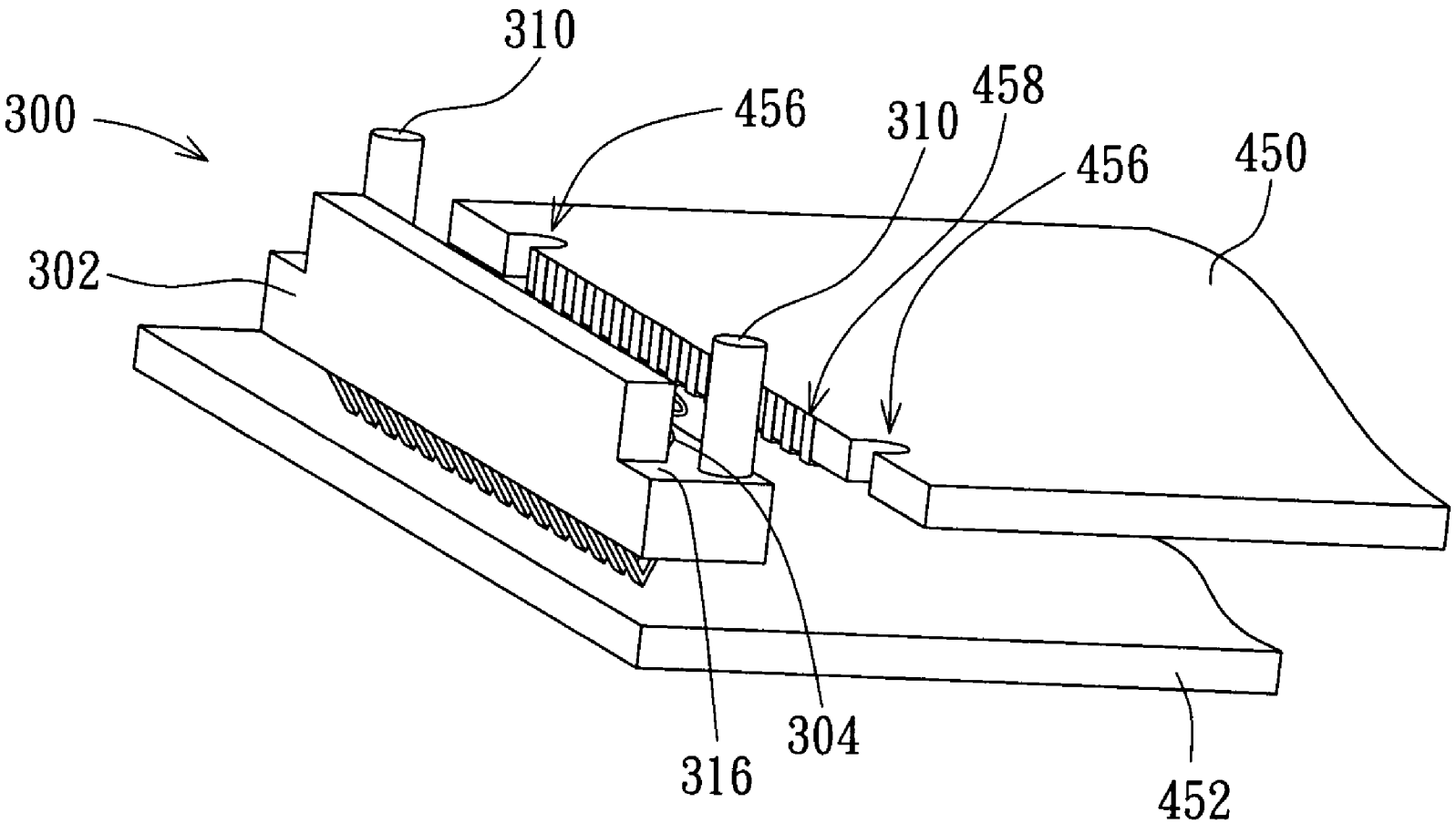
FIG. 6 is a diagram showing the positioning pillar positioning the first circuit board.

Referring to FIG. 6, a diagram showing the positioning pillar positioning the first circuit board 450 is shown. The through hole 454 on the first circuit board 450 can be replaced by an indented groove 456 corresponding to the positioning pillar 310 of the connector 300, that is, the first circuit board 450 has indented grooves 456 disposed thereon.

Meanwhile, the positioning pillar 310 of the connector 300 is for being accommodated in the indented groove 456 of the first circuit board 450, so that the first circuit board 450 can be positioned toward the second direction X2 and that the first circuit board 450 can be fastened on the supporting portion 316 and that the plural electrical contact points 458 aligned on one side of the first circuit board 450 can be electrically connected with the first contact elastic piece 304 disposed on the connector 300 firmly.

Referring to FIG. 3B, considering the convenience of manufacturing process of the connector 300, in another preferred embodiment of the above the invention, the first elastic piece 304 and the second elastic piece 306 of the connector 300 are different parts of a monolithically formed conductive element 318. That is, the first elastic piece 304 and the second elastic piece 306 are parts of the conductive element 318. The conductive element 318 can also be an integrally formed element of the positioning elastic piece 308, the first elastic piece 304 and the second elastic piece 306. The conductive element 318 can be an elastic element disposed inside the L-shaped body 302 and respectively exposes the positioning elastic piece 308 and the first elastic piece 304 out of the lateral side 312 of the L-shaped body 302 and exposes the second elastic piece 306 out of the bottom 314 of the L-shaped body 302, so that the first circuit board 450 can be firmly abutted by the positioning elastic piece 308 and electrically connected with the second circuit board 452.

Figure 7:
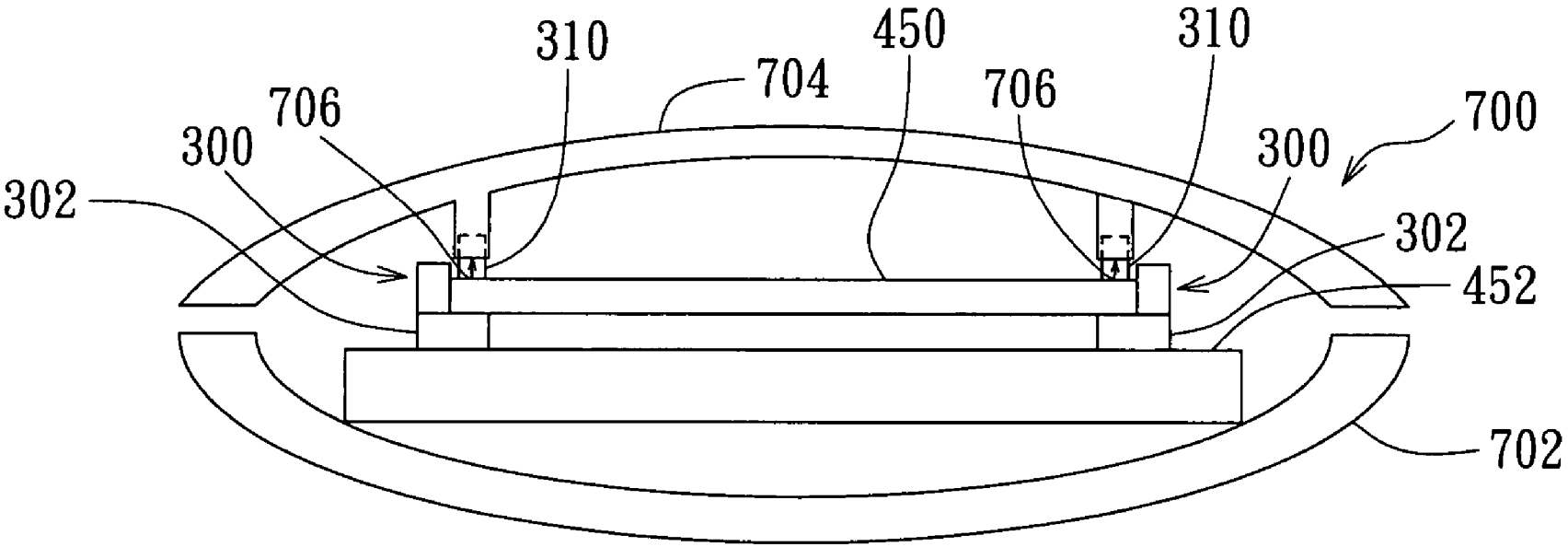
FIG. 7 is a diagram of a connector module electrically connecting the first circuit board and the second circuit board according to the preferred embodiment of the invention.

Referring to FIG. 7, a diagram of a connector module electrically connecting the first circuit board and the second circuit board according to the preferred embodiment of the invention is shown. As shown in the FIG. 7, the two lateral sides of the first circuit board 450 respectively has an electrical contact point (not shown in the diagram), the first contact elastic piece of the connector 300 is electrically connected with the first circuit board 450 at the electrical contact point of the circuit board 450.

The connector module 700 of the invention has a base unit 702 and a cover 704 in addition to the above connector 300. The base unit 702 is for carrying the second circuit board 452, the L-shaped body 302 and the first circuit board 450 of the connector 300 which are electrically connected together.

The cover 704 has a positioning hole 706 corresponding to the positioning pillar 310 of the connector 300. The cover 704 is coupled with the base unit 702 via a lock joint for example. The positioning hole 706 retains the positioning pillar 310 so that the second contact elastic piece 306 as shown in FIG. 3B is electrically connected with the second circuit board 452 firmly.

The connector 300 and connector module 700 for electrically connecting the first circuit board 450 and the second circuit board 452 in above preferred embodiment of the invention can be applied in the communication module of a mobile phone or a notebook computer or can be applied to any device which requires electrically connecting two circuit boards in some circumstances.

Therefore, the above preferred embodiment of the invention enables two circuit boards electrically connected via the interface of the connector 300 or the connector module 700 to have a stronger combination. Furthermore, the two circuit boards connected via the connector 300 or the connector module 700 will not lose electric connection easily when dropped or suffered an external force.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A connector used for electrically connecting a first circuit board and a second circuit board, the connector comprising:

an L-shaped body having a lateral side, a bottom and a supporting portion, the supporting portion supporting the first circuit board;

a first contact elastic piece disposed on and protruding from the lateral side, for being electrically connected with a lateral surface of the first circuit board, said lateral surface being parallel to the lateral side of the L-shaped body; and a second contact elastic piece disposed on and protruding from the bottom and electrically connected with the first contact elastic piece, for being electrically connected with the second circuit board.

2. The connector according to claim 1 further comprising a positioning pillar disposed on the supporting portion, wherein the first circuit board has an indented groove corresponding to the positioning pillar, and the positioning pillar is for being accommodated in the indented groove of the first circuit board supported by the supporting portion, so that the first circuit board is positioned toward a second direction.

3. The connector according to claim 1 further comprising a positioning pillar disposed on the supporting portion, wherein the first circuit board has a through hole corresponding to the positioning pillar, and the positioning pillar is for pinning through the through hole on the first circuit board supported by the supporting portion, so that the first circuit board can be positioned toward a second direction and a third direction.

4. The connector according to claim 1 further comprising a conductive element, wherein a part of the conductive element is disposed inside the L-shaped body, and another part of the conductive element forms the first contact elastic piece and the second contact elastic piece.

5. The connector according to claim 1 further comprising a conductive element with a part of the conductive element being disposed inside the L-shaped body and another part of the conductive element forming the positioning elastic piece, the first contact elastic piece and the second contact elastic piece.

6. The connector according to claim 1, wherein the lateral side of the first circuit board has an electrical contact point disposed thereon, and the first contact elastic piece is electrically connected with the contact point of the first circuit board.

7. The connector according to claim 1 further comprising a positioning elastic piece disposed above the first contact elastic piece and protruding from the lateral side for downwardly abutting a top surface of the first circuit board unwardly supported by the supporting portion, so that the first circuit board is positioned on the L-shaped body in a first direction.

8. The connector according to claim 7, wherein the first contact elastic piece, the second contact elastic piece, and the positioning elastic piece are integrally formed.

9. A connector used for electrically connecting a first circuit board and a second circuit board, the first circuit board having a positioning portion, the connector comprising:

an L-shaped body having a lateral side, a bottom and a supporting portion, the supporting portion being used for supporting the first circuit board;

a first contact elastic piece disposed on and protruding from the lateral side, for being electrically connected with a lateral surface ot the first circuit board, said lateral surface being parallel to the lateral side of the L-shaped body;

a second contact elastic piece disposed on and protruding from the bottom and electrically connected with the first contact elastic piece, for being electrically connected with the second circuit board; and a positioning pillar disposed on the supporting portion, the positioning pillar serving as the positioning portion for the first circuit board supported by the supporting portion, so tat the first circuit board is fastened on the supporting portion.

10. The connector according to claim 9, wherein the positioning portion has a through hole and the positioning pillar pins through the through hole so that the first circuit board is fastened on the supporting portion.

11. The connector according to claim 9, wherein the positioning portion has an indented groove and the positioning pillar is accommodated in the indented groove so that the first circuit board is fastened on the supporting portion.

12. The connector according to claim 9, wherein the connector further comprises a conductive element with a part of the conductive element being disposed inside the L-shaped body and another part of the conductive element forming the first contact elastic piece and the second contact elastic piece.

13. The connector according to claim 9, wherein tbe connector further comprises a positioning elastic piece disposed above the first contact elastic piece and protruding from the lateral side for downwardly abutting a top surface of the first circuit board upwardly supported by the supporting portion, so that the first circuit board is positioned on the L-shaped body in a first direction.

14. The connector according to claim 13, wherein the first contact elastic piece, the second contact elastic piece and the positioning elastic piece are integrally formed.

15. A connector module used for electrically connecting a first circuit board and a second circuit board, the first circuit board having a through hole, the connector module comprising:

an L-shaped body having a lateral side, a bottom and a supporting portion, the supporting portion supporting the first circuit board;

a first contact elastic piece disposed on and protruding from the lateral side, for being electrically connected with a lateral surface of the first circuit board, said lateral surface being parallel to the lateral side of the L-shaped body;

a second contact elastic piece disposed on and protruding from the bottom and electrically connected with the first contact elastic piece, for being electrically connected with the second circuit board;

a positioning pillar, disposed on the supporting portion and corresponds to the through hole, for pinning through the through hole on the first circuit board supported by the supporting portion, so that the first circuit board is fastened on the supporting portion;

a base unit for supporting the second circuit board, the L-shaped body and the first circuit board; and a cover having a positioning hole corresponding to the positioning piUar, the cover being coupled with the base unit, the positioning hole retaining the positioning pillar so that the second contact elastic piece is electrically connected wit the second circuit board firmly.

16. The connector module according to claim 15 further comprising a conductive element with a part of the conductive element being disposed inside the L-shaped body and another part of the conductive element forming the first contact elastic piece and the second contact elastic piece.

17. The connector module according to claim 15 further comprising a positioning elastic piece disposed above the first contact elastic piece and protruding from the lateral side for downwardly abutting a top surface of the first circuit board upwardly supported by the supporting portion, so that the first circuit board is positioned on the L-shaped body in a first direction.

18. The connector module according to claim 17 further comprising a conductive clement with a part of the conductive element being disposed inside the L-shaped body and another part of the conductive element forming the positioning elastic piece, the first contact elastic piece and the second contact elastic piece.

* * * * *